US011756371B1

(12) United States Patent
Haushalter

(10) Patent No.: US 11,756,371 B1
(45) Date of Patent: Sep. 12, 2023

(54) SYSTEMS, METHODS, AND MEDIA FOR IMPLEMENTING INTERNET-BASED WAGERING

(71) Applicant: EVOLUTION MALTA LIMITED, Sliema (MT)

(72) Inventor: Todd Haushalter, St Julians (MT)

(73) Assignee: Evolution Malta Limited, Sliema (MT)

( * ) Notice: Subject to any disclaimer, the term of this patent is extended or adjusted under 35 U.S.C. 154(b) by 0 days.

(21) Appl. No.: 17/246,557

(22) Filed: Apr. 30, 2021

Related U.S. Application Data

(63) Continuation of application No. 16/852,049, filed on Apr. 17, 2020, now Pat. No. 11,011,014, which is a continuation of application No. 16/268,218, filed on Feb. 5, 2019, now Pat. No. 10,629,024.

(60) Provisional application No. 62/626,590, filed on Feb. 5, 2018.

(51) Int. Cl.
*G07F 17/32* (2006.01)

(52) U.S. Cl.
CPC ..... *G07F 17/322* (2013.01); *G07F 17/3213* (2013.01); *G07F 17/3225* (2013.01); *G07F 17/3288* (2013.01)

(58) Field of Classification Search
CPC ..... G07F 17/322; G07F 17/3213; G07F 17/3225; G07F 17/3288
See application file for complete search history.

(56) References Cited

U.S. PATENT DOCUMENTS 4,337,945 A * 7/1982 Levy ..... A63F 9/0079 273/142 E
4,391,442 A * 7/1983 Levy ..... A63F 9/0079 273/142 E
4,396,193 A * 8/1983 Reinhardt ..... G07F 17/3288 463/22
4,869,505 A * 9/1989 Manabe ..... G07F 17/3262 273/142 E
4,906,005 A * 3/1990 Manabe ..... A63F 5/00 463/22

(Continued)

OTHER PUBLICATIONS

Notice of Allowance dated Jan. 22, 2021 in U.S. Appl. No. 16/852,049, pp. 1-41.

(Continued)

*Primary Examiner* — David L Lewis
*Assistant Examiner* — Matthew D Hoel
(74) *Attorney, Agent, or Firm* — Byrne Poh LLP

(57) ABSTRACT

Mechanisms comprising: receiving first bet information for a first bet from a first player's device, the first bet information corresponding to at least a first position on a roulette wheel; receiving second bet information for a second bet from a second player's device, the second bet information corresponding to at least a second position on the roulette wheel that is different from the first position; determining that the roulette wheel and a ball on the roulette wheel have been spun; randomly selecting a first selected position on the wheel, wherein the first selected position is the same as the first position; determining a first payout for first position and a second payout for the second position, wherein the first payout is higher than the second payout; determining that the ball has fallen in the first position; and indicating that the first player is to be paid at the first payout.

30 Claims, 6 Drawing Sheets

(56) References Cited

U.S. PATENT DOCUMENTS 4,995,374 A * 2/1991 Black ..... A01K 15/025 124/32
5,042,810 A * 8/1991 Williams ..... A63F 3/00157 273/143 R
5,588,650 A * 12/1996 Eman ..... G07F 17/32 463/25
5,707,285 A * 1/1998 Place ..... G07F 17/322 463/25
5,718,431 A * 2/1998 Ornstein ..... A63F 3/00157 273/274
5,743,798 A * 4/1998 Adams ..... G07F 17/3262 273/142 E
5,743,800 A * 4/1998 Huard ..... G07F 17/32 463/16
5,788,574 A * 8/1998 Ornstein ..... G07F 17/3244 463/25
5,851,010 A * 12/1998 Feinberg ..... A63F 3/00157 273/274
5,934,999 A * 8/1999 Valdez ..... A63F 3/00157 273/142 E
6,047,965 A * 4/2000 Mollo ..... A63F 5/00 273/142 D
6,059,659 A * 5/2000 Busch ..... A63F 5/00 273/274
RE37,588 E * 3/2002 Ornstein ..... A63F 3/00157 273/274
6,481,717 B1 * 11/2002 Richardelle ..... A63F 3/00157 273/274
6,659,866 B2 * 12/2003 Frost ..... G07F 17/3225 463/17
6,679,492 B2 * 1/2004 Markowiak ..... A63F 3/00157 273/274
6,755,741 B1 * 6/2004 Rafaeli ..... A63F 3/00157 463/25
7,094,150 B2 * 8/2006 Ungaro ..... G07F 17/3211 463/16
7,331,868 B2 * 2/2008 Beaulieu ..... G07F 17/32 463/30
7,661,676 B2 * 2/2010 Smith ..... A63F 1/12 463/31
7,669,853 B2 * 3/2010 Jones ..... A63F 1/18 463/40
7,758,425 B2 * 7/2010 Poh ..... G07F 17/3209 463/16
7,892,083 B2 * 2/2011 Okada ..... A63F 5/00 463/17
8,147,319 B2 * 4/2012 Hornik ..... G07F 17/3239 463/19
8,177,628 B2 * 5/2012 Manning ..... G06Q 20/102 463/16
D663,785 S * 7/2012 Walsh ..... D21/375
8,216,047 B2 * 7/2012 Bartosik ..... G07F 17/3213 463/17
8,272,958 B2 * 9/2012 Smith ..... G07F 17/32 463/33
8,444,470 B2 * 5/2013 Gurule ..... G07F 17/3267 463/30
8,622,830 B2 * 1/2014 Radek ..... G07F 17/3218 463/31
8,727,863 B2 * 5/2014 Gurule ..... A63F 5/00 463/20
9,327,186 B1 * 5/2016 Pececnik ..... A63F 5/0088
9,384,624 B2 * 7/2016 Fong ..... G07F 17/3262
9,552,698 B2 * 1/2017 Berman ..... G07F 17/3213
9,600,974 B2 * 3/2017 Yee ..... G07F 17/3244
9,779,576 B2 * 10/2017 Shoenhair ..... G07F 17/326
10,121,317 B2 * 11/2018 Berman ..... G07F 17/3225
10,147,267 B2 * 12/2018 Yee ..... G07F 17/322
10,504,321 B2 * 12/2019 Burgstaller ..... A63F 5/0005
10,629,024 B1 * 4/2020 Haushalter ..... G07F 17/3288
10,706,668 B2 * 7/2020 Burgstaller ..... G07F 17/3288
11,011,014 B1 * 5/2021 Haushalter ..... G07F 17/3213
11,024,125 B1 * 6/2021 Haushalter ..... G07F 17/3225
11,222,510 B2 * 1/2022 Baskerville ..... G07F 17/3262
2002/0142823 A1 * 10/2002 DeMar ..... G07F 17/3244 463/16
2003/0071417 A1 * 4/2003 Webb ..... A63F 3/00157 273/292
2004/0023712 A1 * 2/2004 Oliver ..... G07F 17/3258 463/18
2004/0116177 A1 * 6/2004 Frost ..... G07F 17/3225 463/17
2004/0166930 A1 * 8/2004 Beaulieu ..... G07F 17/32 463/25
2004/0259627 A1 * 12/2004 Walker ..... G07F 17/34 463/20
2005/0020347 A1 * 1/2005 Moshal ..... A63F 5/00 463/17
2005/0032568 A1 * 2/2005 Griswold ..... G07F 17/32 463/16
2005/0091108 A1 * 4/2005 Frost ..... G07F 17/32 705/14.35
2005/0164759 A1 * 7/2005 Smith ..... G07F 17/32 463/11
2005/0181852 A1 * 8/2005 Groves ..... G07F 17/3293 463/13
2005/0192076 A1 * 9/2005 Lowery ..... A63F 5/00 463/17
2006/0148549 A1 * 7/2006 Walker ..... G07F 17/323 463/16
2007/0060262 A1 * 3/2007 Kosaka ..... A63F 5/00 463/16
2007/0075490 A1 * 4/2007 Gak ..... A63F 3/00157 273/146
2007/0149283 A1 * 6/2007 Poh ..... A63F 13/2145 463/37
2007/0173310 A1 * 7/2007 Walker ..... G07F 17/32 463/16
2007/0254733 A1 * 11/2007 Hornik ..... G07F 17/32 463/20
2008/0058068 A1 * 3/2008 Bennett ..... G07F 17/32 463/20
2008/0132312 A1 * 6/2008 Yoshizawa ..... G07F 17/32 463/16
2008/0139297 A1 * 6/2008 Beaulieu ..... G07F 17/34 463/20
2008/0188288 A1 * 8/2008 Seelig ..... G07F 17/3202 463/20
2008/0254876 A1 * 10/2008 Koustas ..... G07F 17/3272 463/28
2008/0258383 A1 * 10/2008 Sorge ..... A63F 3/00157 273/142 E
2008/0274783 A1 * 11/2008 Walker ..... G07F 17/32 463/43
2009/0005165 A1 * 1/2009 Arezina ..... G07F 17/3244 463/37
2009/0023495 A1 * 1/2009 Koustas ..... G07F 17/32 463/43
2009/0093290 A1 * 4/2009 Lutnick ..... G07F 17/3225 463/16
2009/0098921 A1 * 4/2009 Manning ..... A63F 5/0094 463/17
2009/0239605 A1 * 9/2009 Ekisheva ..... G07F 17/329 463/17
2010/0075744 A1 * 3/2010 Baratti ..... G07F 17/3216 463/31
2010/0120508 A1 * 5/2010 Vann ..... G07F 17/34 463/20
2010/0124966 A1 * 5/2010 Kido ..... G07F 17/34 273/142 E
2010/0148442 A1 * 6/2010 Walker ..... G07F 17/32 273/142 E
2011/0223983 A1 * 9/2011 Schwartz ..... G07F 17/34 463/30
2012/0172102 A1 * 7/2012 Gurule ..... A63F 5/00 463/17
2012/0172103 A1 * 7/2012 Gurule ..... A63F 5/00 463/17

(56) References Cited

U.S. PATENT DOCUMENTS

| | | | | |
|---|---|---|---|---|
| 2013/0053117 | A1* | 2/2013 | Snow | G07F 17/3262 273/303 |
| 2013/0184059 | A1* | 7/2013 | Costello | G07F 17/326 463/22 |
| 2013/0184079 | A1* | 7/2013 | Costello | A63F 9/24 463/42 |
| 2014/0087829 | A1* | 3/2014 | Watkins | G07F 17/3267 463/20 |
| 2014/0094244 | A1* | 4/2014 | Baron | G07F 17/323 463/17 |
| 2014/0100031 | A1* | 4/2014 | Fong | G07F 17/3262 463/31 |
| 2017/0193747 | A1* | 7/2017 | Yee | G07F 17/3286 |

OTHER PUBLICATIONS

Notice of Allowance dated Dec. 16, 2019 in U.S. Appl. No. 16/268,218, pp. 1-25.
Office Action dated Jun. 28, 2019 in U.S. Appl. No. 16/268,218, pp. 1-12.

* cited by examiner

SYSTEMS, METHODS, AND MEDIA FOR IMPLEMENTING INTERNET-BASED WAGERING

CROSS-REFERENCE TO RELATED APPLICATION

This application is a continuation of U.S. patent application Ser. No. 16/852,049, filed Apr. 17, 2020, which is a continuation of U.S. patent application Ser. No. 16/268,218, filed Feb. 5, 2019, now U.S. Pat. No. 10,629,024, which claims the benefit of U.S. Provisional Patent Application No. 62/626,590, filed Feb. 5, 2018, each of which is hereby incorporated by reference herein in its entirety.

BACKGROUND

Wagering is a popular recreational activity for adults around the world. In traditional wagering, a player would have to travel to a casino to place wagers. While casinos are enjoyable, traveling to one can be expensive and time consuming.

Internet-based wagering system allow players to wager from home without the need to travel to a casino. Unfortunately, however, many Internet-based wagering systems are simply computer-generated interfaces that do not replicate in any way a real environment like is present in a casino.

Accordingly, it is desirable to provide Internet-based wagering that replicates aspects of a real casino.

SUMMARY

Systems, methods, and media for implementing internet-based wager are provided. In accordance with some embodiments, systems for wagering are provided, the systems comprising: a roulette wheel; a ball configured to be used in the roulette wheel; a hardware processor configured to: receive first bet information for a first bet from a first player device of a first player, the first bet information corresponding to at least a first position on the roulette wheel; receive second bet information for a second bet from a second player device of a second player, the second bet information corresponding to at least a second position on the roulette wheel that is different from the first position; determine that the roulette wheel and the ball have been spun; randomly select a first selected position on the roulette wheel, wherein the first selected position is the same as the first position; determine a first payout for first position and a second payout for the second position, wherein the first payout is higher than the second payout; determine that the ball has fallen in the first position; and indicating that the first player is to be paid at the first payout.

In accordance with some embodiments, methods for wagering are provided, the methods comprising: receiving, using a hardware processor, first bet information for a first bet from a first player device of a first player, the first bet information corresponding to at least a first position on a roulette wheel; receiving, using the hardware processor, second bet information for a second bet from a second player device of a second player, the second bet information corresponding to at least a second position on the roulette wheel that is different from the first position; determining, using the hardware processor, that the roulette wheel and a ball on the roulette wheel have been spun; randomly selecting, using the hardware processor, a first selected position on the roulette wheel, wherein the first selected position is the same as the first position; determining, using the hardware processor, a first payout for first position and a second payout for the second position, wherein the first payout is higher than the second payout; determining, using the hardware processor, that the ball has fallen in the first position; and indicating, using the hardware processor, that the first player is to be paid at the first payout.

In accordance with some embodiments, non-transitory computer-readable media containing computer executable instructions that, when executed by a processor, cause the processor to perform a method for wagering are provided, the method comprising: receiving first bet information for a first bet from a first player device of a first player, the first bet information corresponding to at least a first position on a roulette wheel; receiving second bet information for a second bet from a second player device of a second player, the second bet information corresponding to at least a second position on the roulette wheel that is different from the first position; determining that the roulette wheel and a ball on the roulette wheel have been spun; randomly selecting a first selected position on the roulette wheel, wherein the first selected position is the same as the first position; determining a first payout for first position and a second payout for the second position, wherein the first payout is higher than the second payout; determining that the ball has fallen in the first position; and indicating that the first player is to be paid at the first payout.

DETAILED DESCRIPTION

Figure 1:
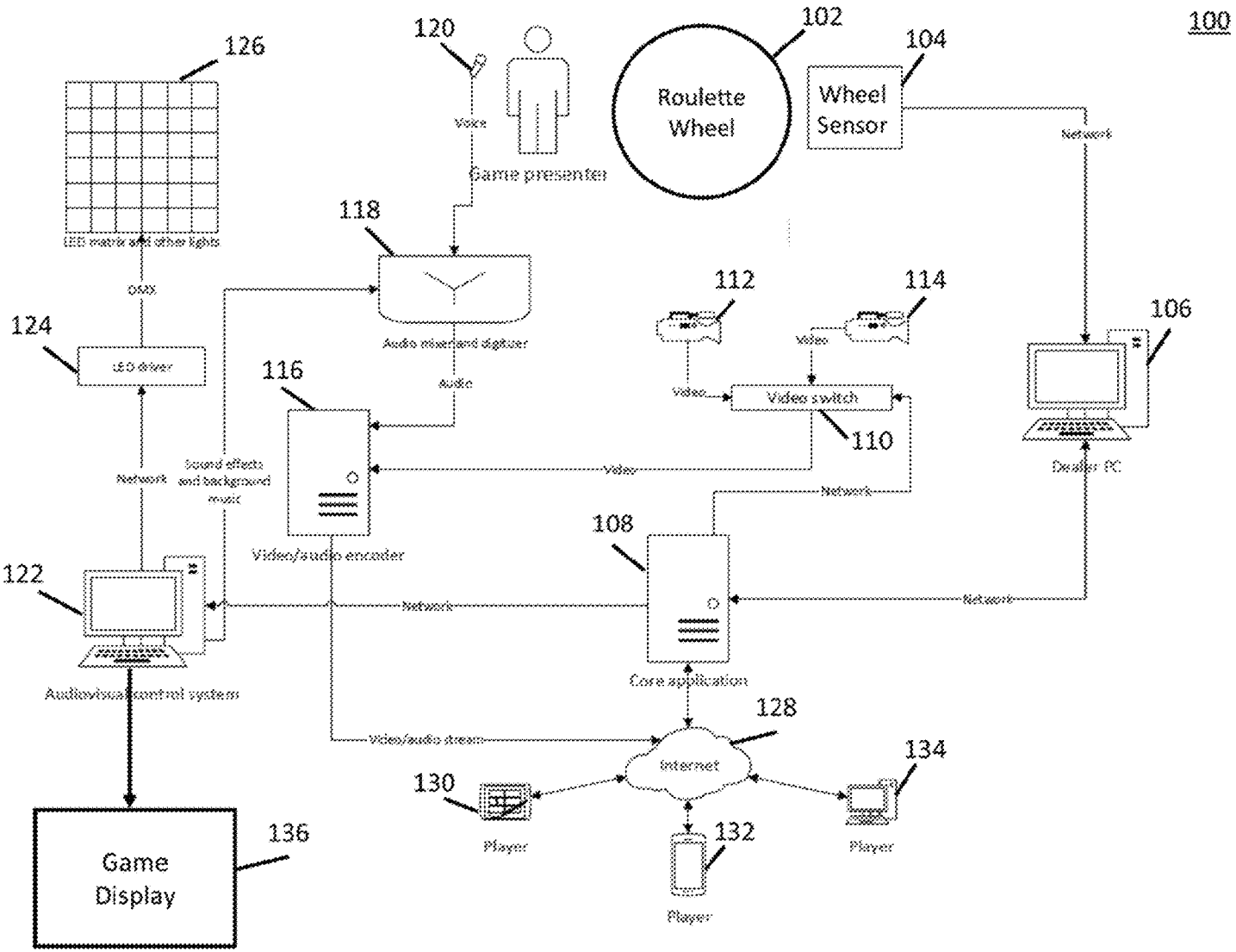
FIG. 1 is an example of a system for implementing an Internet-based wagering system in accordance with some embodiments.

Turning to FIG. 1, an example 100 of a system for implementing Internet-based wagering in accordance with some embodiments is shown. As illustrated, system 100 includes a roulette wheel 102, a wheel sensor 104, a dealer computer 106, a core application computer 108, a video switch 110, cameras 112 and 114, a video/audio encoder 116, an audio mixer and digitizer 118, a microphone 120, an audiovisual control system 122, an LED driver 124, an LED matrix 126, a computer network 128, a tablet player device 130, a smart phone player device 132, a computer player device 134, and a game display 136.

Roulette wheel 102 can be any suitable roulette wheel. This roulette wheel can be a real, physical roulette wheel. For example, roulette wheel 102 can be a single zero or double zero roulette wheel. In some embodiments, when implemented as a single zero roulette wheel, the wheel can have 37 positions number as follows: 0, 32, 15, 19, 4, 21, 2, 25, 17, 34, 6, 27, 13, 36, 11, 30, 8, 23, 10, 5, 24, 16, 33, 1, 20, 14, 31, 9, 22, 18, 29, 7, 28, 12, 35, 3 and 26. In some embodiments, when implemented as a double zero roulette wheel, the wheel can have 38 positions number as follows: 0, 28, 9, 26, 30, 11, 7, 20, 32, 17, 5, 22, 34, 15, 3, 24, 36, 13, 1, 00, 27, 10, 25, 29, 12, 8, 19, 31, 18, 6, 21, 33, 16, 4, 23, 35, 14, and 2. During use, in some embodiments, a human dealer (or game presenter) spins the wheel by hand and projects a ball around the wheel in a direction opposite to the wheel rotation. Eventually the wheel and ball slow relative to each other and the ball falls into a position on the wheel. One or more cameras, described below, can be pointed at the wheel and capture video that is transmitted to player devices participating in a game involving the wheel.

Referring back to FIG. 1, wheel sensor 104 can detect the spinning of the wheel and the position in which the ball falls. The sensor can be implemented in any suitable manner. For example, the sensor can be implemented as a camera. In some embodiments, multiple sensors can be used and the sensors can be of the same or different types.

Dealer computer 106 can be any suitable computer that can be used by a game presenter to monitor game activity. For example, in some embodiments, computer 106 can be used to monitor how sensor 104 is sensing the wheel, to manually enter wheel position data, to view video feeds of the wheel, and to see gaming data relating to bets, payouts, previous plays, and/or any other suitable data.

Core application computer 108 can be any suitable computer that controls the activity of the game being presented by system 100. This can include generating user interfaces, presenting user interfaces to devices 130, 132, and 134, receiving input from players via those user interfaces, receiving bet information, causing money wagered to be collected, receiving data from sensor 104 and/or computer 106, applying game rules, determining payouts, causing payout money to be paid, controlling video that is streamed to players, and/or any other suitable functions.

Video switch 110 can receive video from cameras 112 and 114 and provide it to video/audio encoder 116. Any suitable video switch can be used in some embodiments.

Video/audio encoder 116 can be any suitable video and/or audio encoder. In some embodiments, encoder 116 can be implemented as multiple encoders, any of which encoders can be different from any others of the encoders. For example, when using multiple encoders, some may be video encoders and some may be audio encoders. Some may be high definition encoders, while others can be standard definition encoders, as another example.

Audio mixer and digitizer 118 can be any suitable audio mixer and digitizer for receiving sound-effect signals and background-music signals from audiovisual control system 122 and voice signals from microphone 120, mixing those signals, digitizing those signals, and providing those signals to encoder 116.

Microphone 120 can be any suitable microphone for capturing the voice of a game presenter (or dealer). In some embodiments, microphone 120 can be part of another device, such as a headset, one of cameras 112 and 114, etc.

Audiovisual control system 122 can be any suitable computer system for controlling sound effects, background music, light emitting diodes in matrix 126, any other suitable lights, etc. In some embodiments, system 122 can receive inputs from core application computer 108 that causes special sounds and/or lights (or any other effects) to be presented when certain events happen during the course of play (e.g., such as a big payout being paid).

LED driver 124 can be any suitable driver circuitry for driving LEDs, lights, and/or any other visual effects that are presented on or around the wheel and/or in the field of view of one or more of cameras 112 and 114.

LED matrix 126 can be any suitable collection of one or more LEDs, lights, and/or any other visual effects that are presented on or around the wheel and/or in the field of view of one or more of cameras 112 and 114.

Computer network 128 can be any suitable communication network or combination of communication networks that can be used by a device 130, 132, and/or 134 for communicating with the remainder of system 100. For example, network 128 can include the Internet, one or more mobile telephone networks, one or more mobile data networks, one or more cable television networks, one or more satellite networks, one or more WiFi networks, one or more local area networks, one or more wide area networks, and/or any other one or more suitable communication networks.

Figure 3:
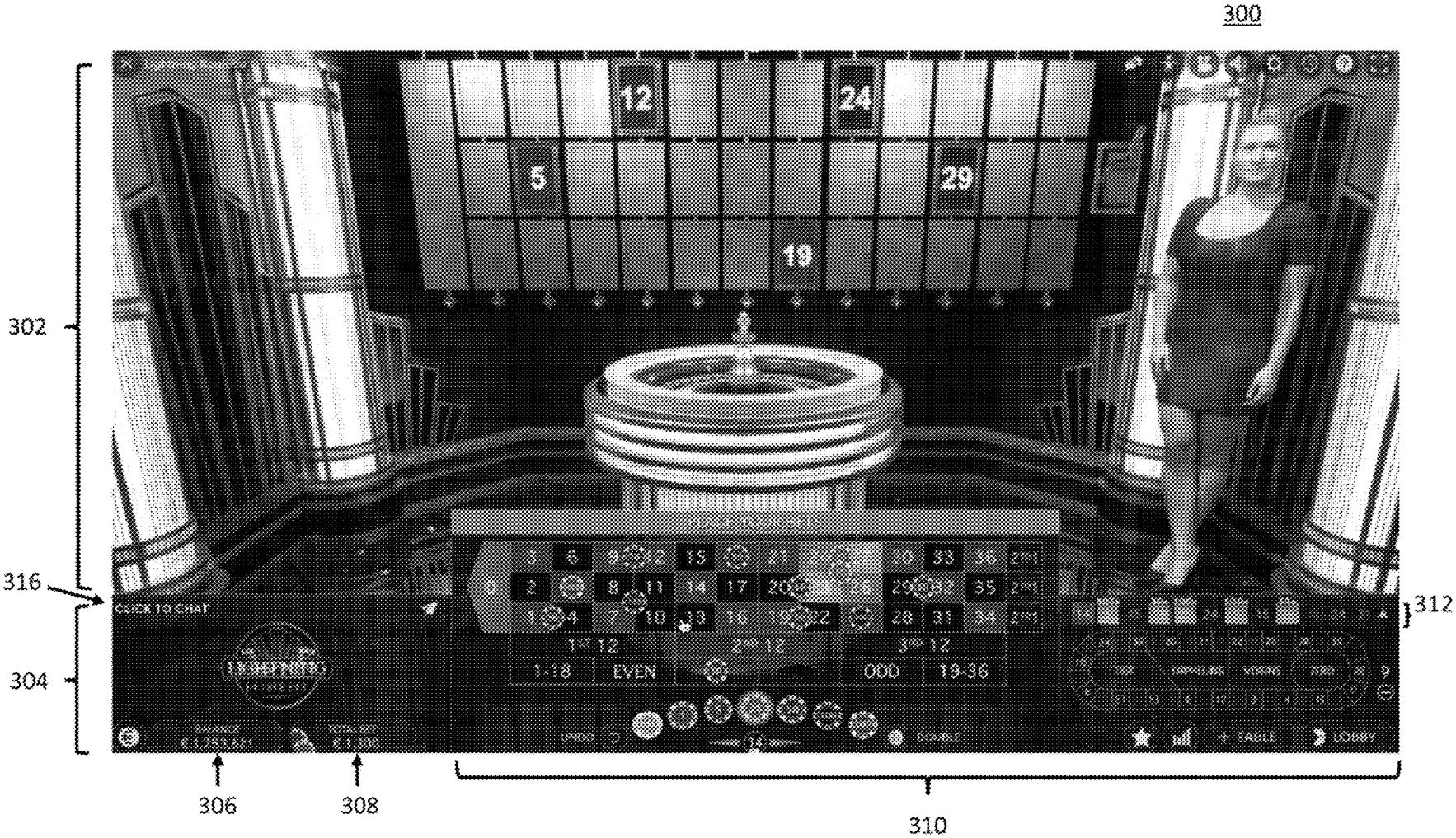
FIG. 3 is an example of a user interface for Internet-based wagering in accordance with some embodiments.
Figure 4:
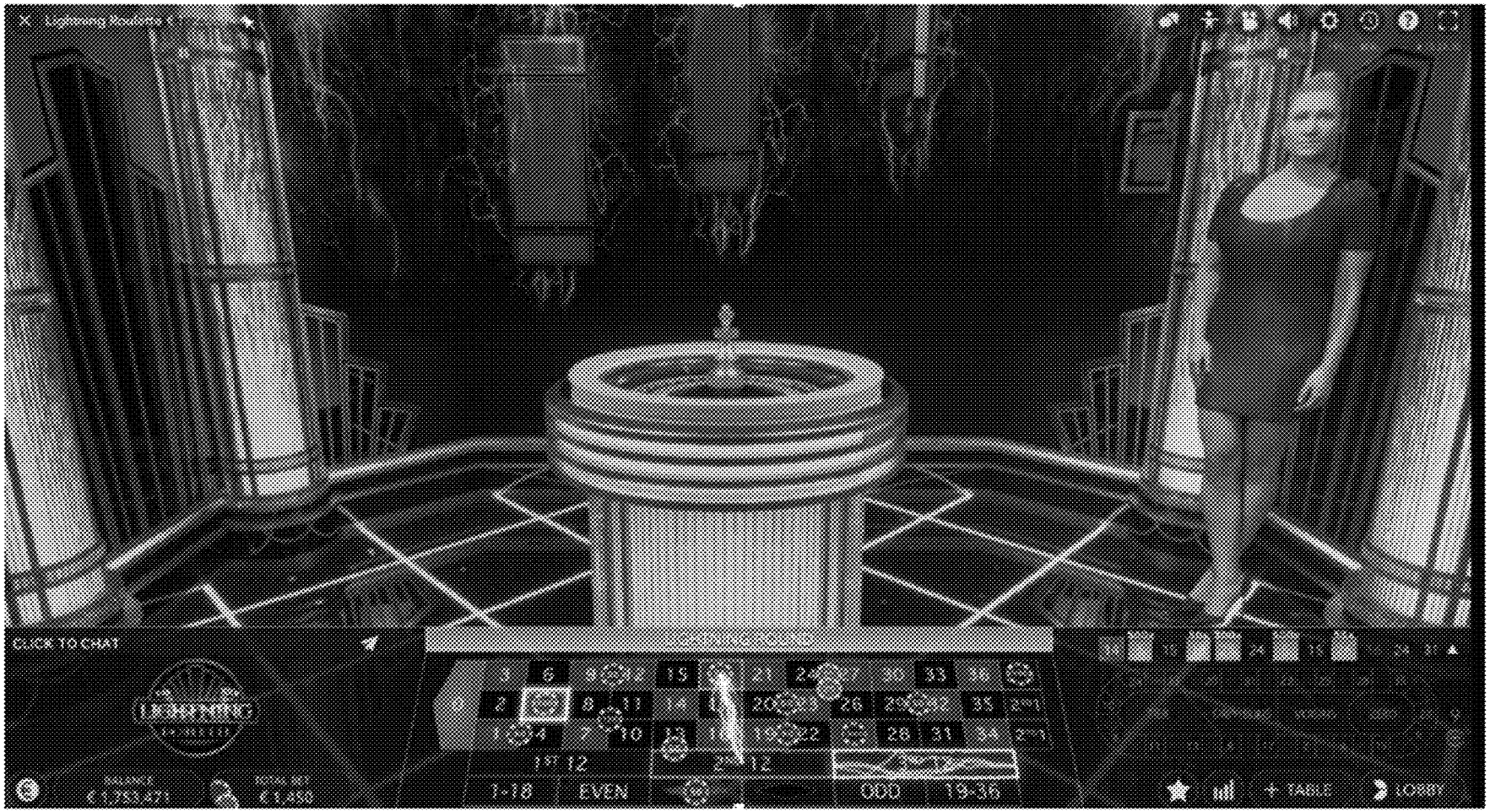
FIG. 4 is an example of a user interface for Internet-based wagering showing an enhanced visual effect in accordance with some embodiments.
Figure 5:
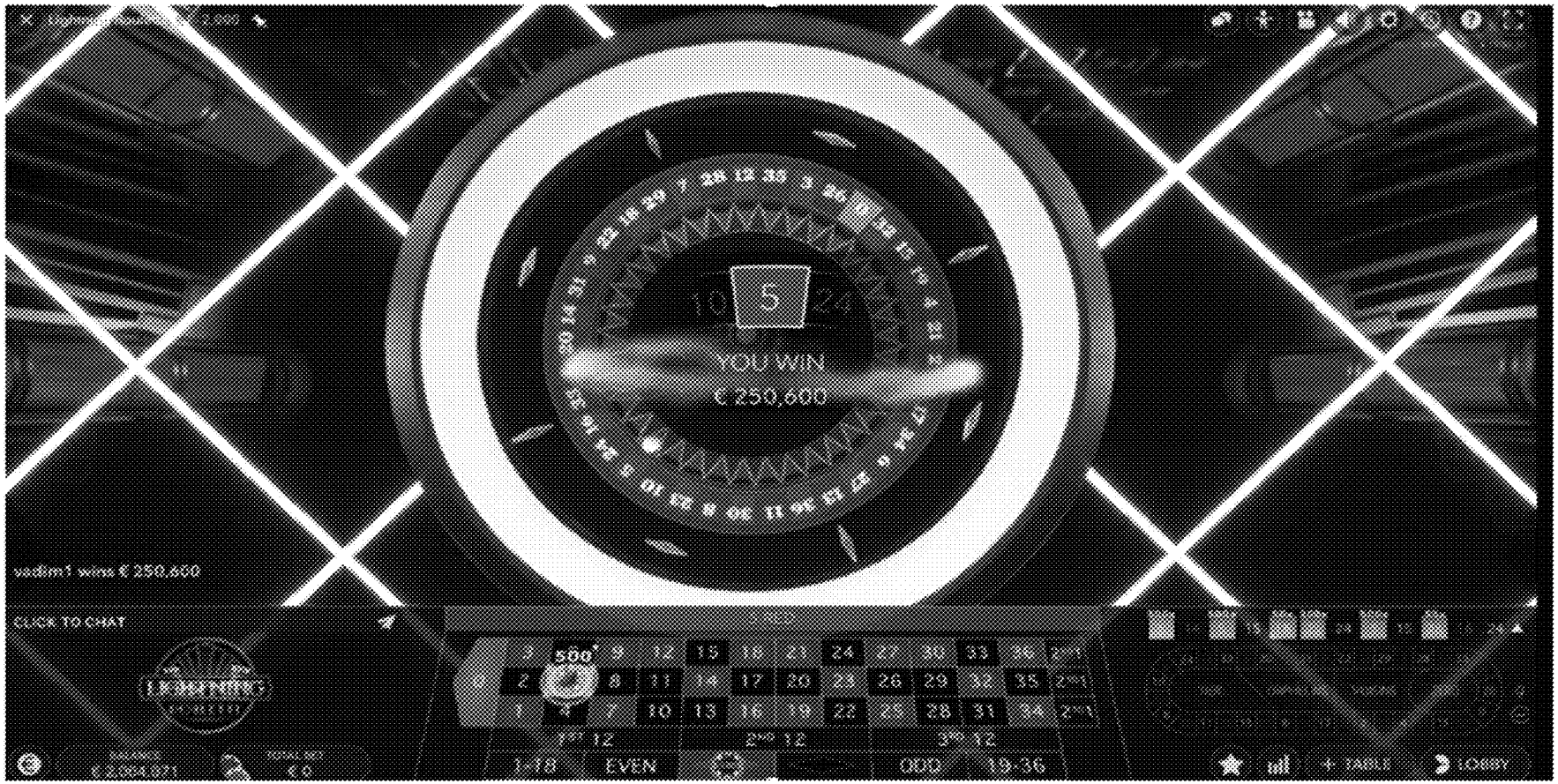
FIG. 5 is an example of a user interface for Internet-based wagering after a ball drops on a roulette wheel in accordance with some embodiments

Player devices 120, 132, and 134 can be any suitable devices for interacting with the remainder of system 100. For example, as shown in FIGS. 3, 4, and 5, these devices can present a user interface, video, and audio that can allow a player to experience a wagering game. The devices can receive bets via the interface, indicate account balance, indicate past plays, provide video and/or audio of the wheel, provide video and/or audio of the game presenter, provide video and/or audio of the video effects, audio effects, music, etc., capture video and/or audio of a player using one of the devices, capture text input of the player, provide video and/or audio of other players, present text input of the other players, etc.

Game display 136 can be any suitable display for presenting visual effects in the field of view of one or more cameras. For example, game display 136 can be implemented as a large display that is present behind the roulette wheel and dealer as shown in FIGS. 3, 4, and 5.

Figure 2:
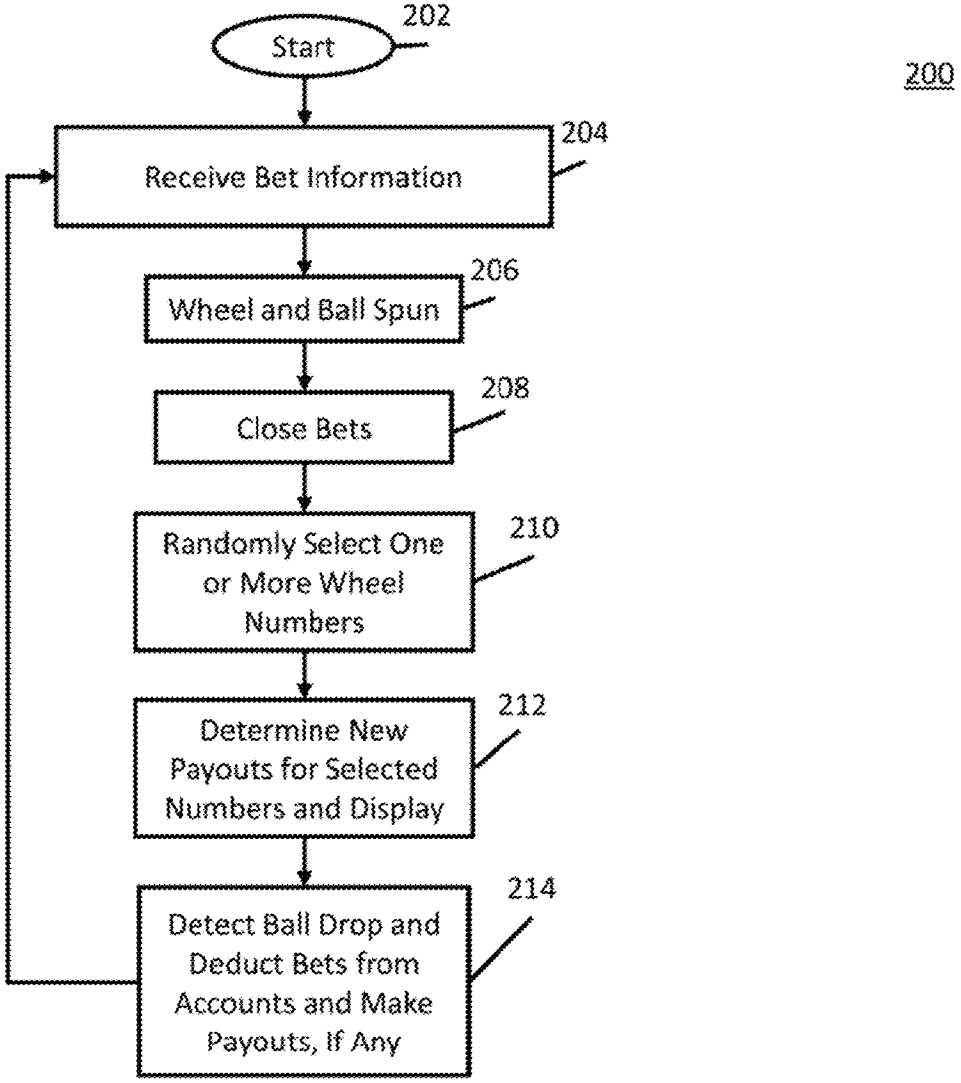
FIG. 2 is an example of a process for a wager game in accordance with some embodiments.

Turning to FIG. 2, an example 200 of a process for implementing a wagering game in accordance with some embodiments is shown. As illustrated, after process 200 begins at 202, the process can receive bet information at 204. Any suitable bet information can be received in some embodiments. For example, in some embodiments, the bet information can include any suitable roulette bet (as known in the art)), such as a bet on one or more wheel positions and an amount wagered (e.g., $20).

Next, at 206, a roulette wheel and ball can be spun. This can be performed in any suitable manner. For, example, in some embodiments, the wheel and ball can be spun by dealer (or game presenter) in response to a message on dealer computer 106 or any other suitable indicator. As another example, in some embodiments, the wheel and ball can be automatically spun under the control of a hardware processor.

At 208, bets can then be closed by process 200. This can occur in response to a game presenter selecting on dealer computer 106 to close bets, based on an automatic timer, and/or based on any other suitable factors. Once bets are closed, players may be prevented from adding new bets, cancelling existing bets, and/or altering existing bets. In some embodiments, bets can close before the roulette wheel and ball are spun.

Then, at 210, process 200 can randomly select one or more of the roulette wheel numbers. These numbers can be selected in any suitable manner and any suitable number of numbers can be selected. For example, a pseudo-random number generator function can be used by the process 200 to select five random numbers. Although the term "random" is used herein, it should be understood that pseudo-random functions can be used to approximate random functions and thereby select pseudo-random numbers, which can be considered to be random numbers.

In some embodiments, the numbers that are selected at 210 can correspond to certain bet types. For example, a player may be able to place a bet on the first twelve numbers (i.e., numbers 1 through 12), and these numbers may be selected at 210 in some embodiments. As another example, a player may be able to place a bet on the even numbers (i.e., numbers 2, 4, 6, . . . , 36), and these numbers may be selected at 210 in some embodiments.

In some embodiments, any suitable visual effect can be presented to enhance the player's experience. For example, in some embodiments, a representation of simulated lightning striking a number can be presented on the simulated roulette board and/or on a display (e.g., display 136) behind the dealer.

At 212, process 200 can next determine the increased payouts for the numbers selected at 210. Any suitable payouts can be used in some embodiments. For example, in some embodiments, increased payouts for the selected numbers can range from 49:1 to 499:1. The payout may correspond to the order of numbers that are selected. For example, in some embodiments, the first three numbers that are selected can be assigned a 49:1 payout, and the last two numbers that are selected can be assigned a 499:1 payout. In some embodiments, two or more of the selected numbers can be assigned the same increased payout, or all selected numbers can be assigned different increased payouts. The payout for numbers not selected at 210 can be set to account for the increased payouts of the selected numbers. For example, in some embodiments, the payout for the numbers not selected can be set to 29:1. The selected numbers and the increased payouts can then be displayed to the dealer and players.

Then at 214, process 200 can detect the ball dropping into a position on the roulette wheel, deduct bet money from player accounts (in some embodiments, the bet money may have been previously deducted or frozen at step 204 or 208), and make payouts of money.

Following 214, process 200 clears all bet information and loops back to 204 to proceed with the next play as described above.

In some embodiments, process 200 can be executed in computer 108.

Turning to FIG. 3, an example 300 of a user interface than can be presented on a player device 130, 132, or 134 in accordance with some embodiments is shown. As illustrated, interface 300 can include a video area 302 and a betting interface area 304. Video area can show any suitable video including video of the roulette wheel, video of a game presenter, video of LEDs, lights, displays, and/or other visual effects that are captured using cameras 112 and 114. As described above, this video is of a real environment including a real roulette wheel, real lights, a real game presenter, etc.

In some embodiments, video area 302 can show feedback 314 to the players of the position in which a ball drops following a spin of the roulette wheel.

Betting interface area 304 can provide any suitable user interface elements for wagering in the game provided. For example, as shown, an account balance 306 and total bet amount 308 can be provided to show a player how much money the player has in the betting account and how much money the player is currently wagering. As another example, as shown in area 310, the player can select a position on the roulette wheel on which to bet by selecting a virtual chip and selecting a desired place on the simulated roulette board. For example, as shown in the figure, the player has selected to position a "50" chip (which can have a value of 50 Euros) on positions 1 and 4 to place a split bet on the numbers 1 and 4. As another example, as also shown in the figure, the player has selected to position a "50" chip on the "red" box to place a bet on all red numbers. As yet another example, as shown in area 312, previous play information can be shown. As illustrated, "14" was the number on which the ball dropped on the most recent spin, "5" was the number on the spin before that, and "15" was the number before that. As illustrated, numbers may be shown with indicators indicating increased payouts. For example, "5" shows "500×" to indicate an increased payout of 499:1 (499:1 plus the original bet return is 500×).

In some embodiments, as shown in FIG. 3, as numbers are chosen in player bets, those numbers can be shown in the display presented behind the roulette wheel and dealer. The larger the bet, the brighter the number may be presented in the display. Other effect, such as a shaking of a number can be shown on the display to add to player excitement.

Turning to FIG. 4, an example of a visual effect of numbers being randomly selected is shown. For example, the "5" and the "3rd of 12" numbers are shown with lightning effects. Any suitable visual effect can be used in some embodiments. In some embodiments, no visual effect can be used.

Turning to FIG. 5, an example of an interface after a ball drops is shown. As illustrated, a top-down view of a roulette wheel may be shown along with an indicator of the number on which the ball dropped, a payout amount, and a simulated lightning effect to show that the ball dropped on randomly selected number. As also shown, a "500*" indicator may be shown over the winning position on the roulette board.

Figure 6:
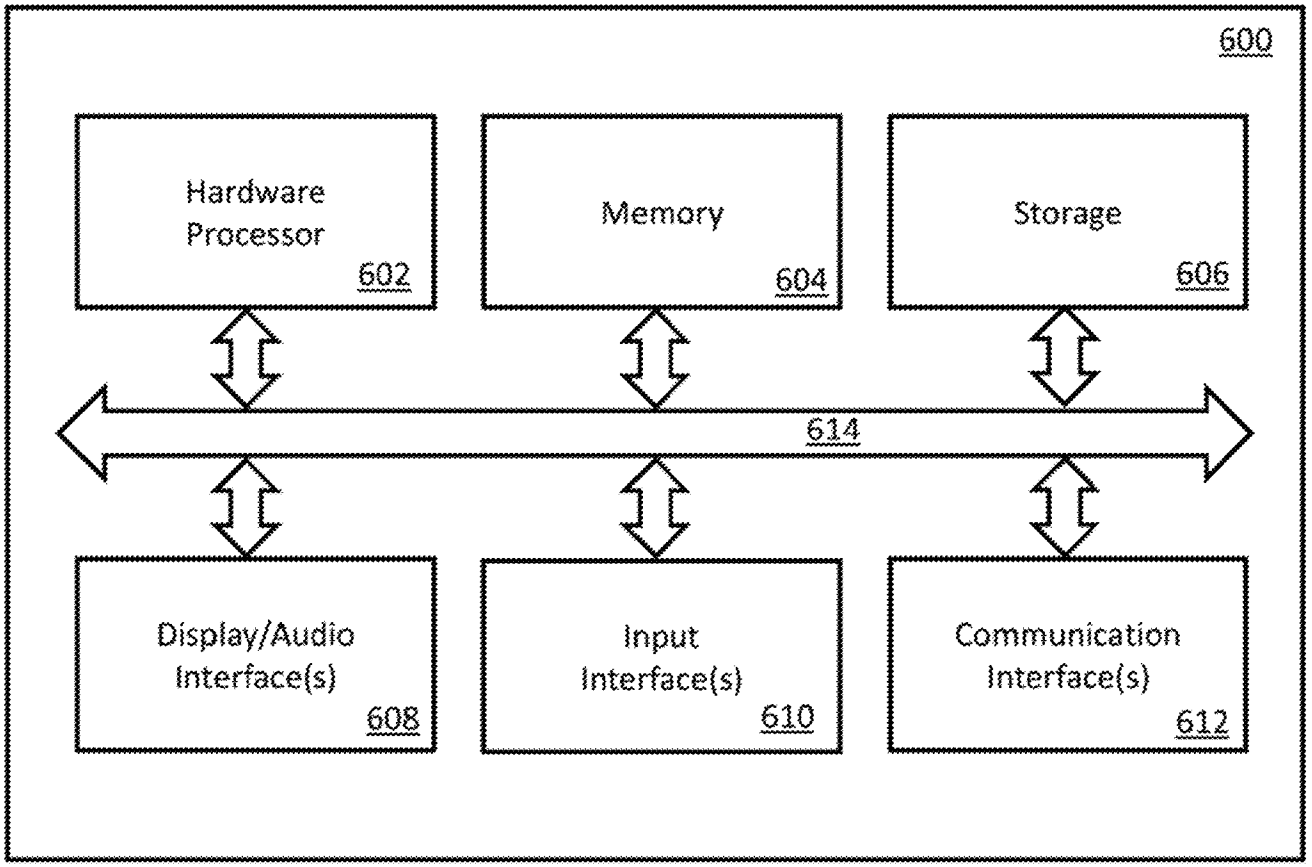
FIG. 6 is an example of hardware for implementing certain components of FIG. 1 in accordance with some embodiments.

Referring back to FIG. 1, components 106, 108, 116, 122, 130, 132, and 134 can be implemented using any suitable hardware. For example, in some embodiments, these components can be implemented using any suitable general-purpose computer or special-purpose computer. Any such general-purpose computer or special-purpose computer can include any suitable hardware. For example, as illustrated in example hardware 600 of FIG. 6, such hardware can include hardware processor 602, memory 604, storage 606, display/audio interface(s) 608, input interface(s) 610, communication interface(s) 612, and a bus 614.

Hardware processor 602 can include any suitable hardware processor, such as a microprocessor, a micro-controller, digital signal processor(s), dedicated logic, and/or any other suitable circuitry for controlling the functioning of a general-purpose computer or a special-purpose computer in some embodiments.

Memory 604 can be any suitable memory for storing programs, data, media content, and/or any other suitable information in some embodiments. For example, memory 604 can include random access memory, read-only memory, flash memory, and/or any other suitable memory.

Storage 606 can be any suitable storage for storing programs, data, media content, and/or any other suitable information in some embodiments. For example, storage 606 can include flash memory, hard disk drive, optical media, and/or any other suitable storage.

Display/audio interface(s) 608 can be any suitable circuitry for controlling and driving output to one or more display/audio output circuitries in some embodiments. For example, display/audio interface(s) 608 can be circuitry for driving an LCD display, a speaker, an LED, or any other type of output device.

Input interface(s) 610 can be any suitable circuitry for controlling and receiving input from any suitable input device(s) in some embodiments. For example, input interface(s) 610 can be any suitable circuitry for receiving input from an input device, such as a touch screen, from one or more buttons, from a voice recognition circuit, from a microphone, from a camera, from an optical sensor, from an accelerometer, from a temperature sensor, from a near field sensor, and/or any other type of input device.

Communication interface(s) 612 can be any suitable circuitry for interfacing with one or more communication networks, such as network 128 as shown in FIG. 1. For example, interface(s) 612 can include network interface card circuitry, wireless communication circuitry, and/or any other suitable type of communication network circuitry.

Bus 614 can be any suitable mechanism for communicating between two or more components 602, 604, 606, 608, 610, and 612 in some embodiments.

Any other suitable components can be included in hardware 600 in accordance with some embodiments.

It should be understood that at least some of the above described blocks of the process of FIG. 2 can be executed or performed in any order or sequence not limited to the order and sequence shown in and described in the figure. Also, some of the above blocks of the process of FIG. 2 can be executed or performed substantially simultaneously where appropriate or in parallel to reduce latency and processing times. Additionally or alternatively, some of the above described blocks of the process of FIG. 2 can be omitted.

In some implementations, any suitable computer readable media can be used for storing instructions for performing the functions and/or processes described herein. For example, in some implementations, computer readable media can be transitory or non-transitory. For example, non-transitory computer readable media can include media such as non-transitory forms of magnetic media (such as hard disks, floppy disks, etc.), non-transitory forms of optical media (such as compact discs, digital video discs, Blu-ray discs, etc.), non-transitory forms of semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

In some embodiments, the mechanisms described herein can be used to implement an Internet based gaming product. In some embodiments of such a product, the roulette wheel and dealer can be located in a studio (or any other suitable location (such as a casino)) and players use a player device from a remote location to place bets. In some embodiments, the mechanisms described herein can be additionally or alternatively be used to implement a casino game in which the roulette wheel and dealer are in a casino and players use player devices (which can be the player devices described in connection with FIG. 1 and/or dedicated gaming devices, such as a gaming terminal) within the casino. In some embodiments, the mechanisms described herein can be implemented in a fully electronic manner wherein no dealer or real roulette wheel is present. Rather, the roulette wheel can be computer generated. Players can access the game using the player devices described in connection with FIG. 1 and/or dedicated gaming devices, such as a gaming terminal. This can be implemented in a casino and/or over the Internet.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A system for wagering, comprising:

a ball;

a roulette wheel having a plurality of positions into which the ball can land after a spin of the roulette wheel; and at least one hardware processor collectively configured to:

randomly or pseudo-randomly select a first selected position of the plurality of positions on the roulette wheel to have a first increased payout for the spin of the roulette wheel prior to the ball landing into any of the plurality of positions on the roulette wheel for the spin;

determine that the ball has landed into the first selected position for the spin; and determine that the first increased payout is applicable to a first bet made on the first selected position for the spin of the roulette wheel, wherein the first increased payout is greater than a first non-selected payout that would have been applicable to the first bet on the first selected position for the spin had the first selected position not been selected by the randomly or pseudo-randomly selecting the first selected position for the spin.

2. The system of claim 1, further comprising a display that identifies the first selected position.

3. The system of claim 2, further comprising a camera having the roulette wheel and the display in its field of view, wherein the hardware processor is further configured to cause images from the camera to be presented on a first player device.

4. The system of claim 1, wherein the at least one hardware processor is further collectively configured to:

randomly or pseudo-randomly select a second selected position of the plurality of positions on the roulette wheel to have a second increased payout for the spin of the roulette wheel prior to the ball landing into any of the plurality of positions on the roulette wheel for the spin, wherein the second increased payout for the second selected position is greater than a second non-selected payout that would have been applicable to a second bet on the second selected position for the spin had the second selected position not been selected by the randomly or pseudo-randomly selecting the second selected position for the spin, and wherein the second increased payout is different than the first increased payout.

5. The system of claim 1, wherein the at least one hardware processor is further collectively configured to cause the ball and the roulette wheel to automatically spin.

6. The system of claim 1, wherein the at least one hardware processor is further collectively configured to cause a first graphical user interface to be presented, wherein the first graphical user interface includes a roulette board in which the first selected position is highlighted.

7. The system of claim 6, wherein the at least one hardware processor is further configured to indicate "500×" at the first selected position on the roulette board in the first graphical user interface.

8. The system of claim 1, wherein the first increased payout is 49:1.

9. The system of claim 8, wherein the first non-selected payout is 29:1.

10. The system of claim 1, wherein the first bet is a bet on a single position on the roulette wheel.

11. A method for wagering, comprising:

causing, by at least one hardware processor, a first graphical user interface to be presented on a first player device, wherein the first graphical user interface includes a roulette board;

randomly or pseudo-randomly selecting a first selected position of a plurality of positions on a roulette wheel to have a first increased payout for a spin of the roulette wheel prior to a ball landing into any of the plurality of positions on the roulette wheel for the spin;

determining that the ball has landed into the first selected position for the spin; and determining that the first increased payout is applicable to a first bet made on the first selected position for the spin of the roulette wheel, wherein the first increased payout is greater than a first non-selected payout that would have been applicable to the first bet on the first selected position for the spin had the first selected position not been selected by the randomly or pseudo-randomly selecting the first selected position for the spin.

12. The method of claim 11, further comprising causing the first selected position to be identified on a display.

13. The method of claim 12, further comprising causing images from a camera to be presented on the first player device, wherein the camera has the roulette wheel and the display in its field of view.

14. The method of claim 11, further comprising:

randomly or pseudo-randomly selecting a second selected position of the plurality of positions on the roulette wheel to have a second increased payout for the spin of the roulette wheel prior to the ball landing into any of the plurality of positions on the roulette wheel for the spin, wherein the second increased payout for the second selected position is greater than a second non-selected payout that would have been applicable to a second bet on the second selected position for the spin had the second selected position not been selected by the randomly or pseudo-randomly selecting the second position for the spin, and wherein the second increased payout is different than the first increased payout.

15. The method of claim 11, further comprising causing the ball and the roulette wheel to automatically spin.

16. The method of claim 11, wherein the first selected position is highlighted in the roulette board.

17. The method of claim 16, further comprising indicating "500×" at the first selected position on the roulette board in the first graphical user interface.

18. The method of claim 11, wherein the first increased payout is 49:1.

19. The method of claim 11, wherein the first bet is a bet on a single position on the roulette wheel.

20. The method of claim 18, wherein the first non-selected payout is 29:1.

21. A non-transitory computer-readable medium containing computer executable instructions that, when executed by at least one processor, cause the at least one processor to perform a method for wagering, the method comprising:

randomly or pseudo-randomly selecting a first selected position of a plurality of positions on a roulette wheel to have a first increased payout for a spin of the roulette wheel prior to a ball landing into any of the plurality of positions on the roulette wheel for the spin;

determining that the ball has landed into the first selected position for the spin; and determining that the first increased payout is applicable to a first bet made on the first selected position for the spin of the roulette wheel, wherein the first increased payout is greater than a first non-selected payout that would have been applicable to the first bet on the first selected position for the spin had the first selected position not been selected by the randomly or pseudo-randomly selecting the first selected position for the spin.

22. The non-transitory computer-readable medium of claim 21, wherein the method further comprises causing the first selected position to be identified on a display.

23. The non-transitory computer-readable medium of claim 22, wherein the method further comprises causing images from a camera to be presented on a first player device, wherein the camera has the roulette wheel and the display in its field of view.

24. The non-transitory computer-readable medium of claim 21, wherein the method further comprises:

randomly or pseudo-randomly selecting a second selected position of the plurality of positions on the roulette wheel to have a second increased payout for the spin of the roulette wheel prior to the ball landing into any of the plurality of positions on the roulette wheel for the spin, wherein the second increased payout for the second selected position is greater than a second non-selected payout that would have been applicable to a second bet on the second selected position for the spin had the second selected position not been selected by the randomly or pseudo-randomly selecting the second selected position for the spin, and wherein the second increased payout is different than the first increased payout.

25. The non-transitory computer-readable medium of claim 21, wherein the method further comprises causing the ball and the roulette wheel to automatically spin.

26. The non-transitory computer-readable medium of claim 21, wherein the method further comprises causing a first graphical user interface to be presented, wherein the first graphical user interface includes a roulette board in which the first selected position is highlighted.

27. The non-transitory computer-readable medium of claim 26, wherein the method further comprises indicating "500×" at the first selected position on the roulette board in the first graphical user interface.

28. The non-transitory computer-readable medium of claim 21, wherein the first increased payout is 49:1.

29. The non-transitory computer-readable medium of claim 28, wherein the first non-selected payout is 29:1.

30. The non-transitory computer readable medium of claim 21, wherein the first bet is a bet on a single position on the roulette wheel.

* * * * *